US007074096B2

(12) United States Patent
Copper et al.

(10) Patent No.: US 7,074,096 B2
(45) Date of Patent: Jul. 11, 2006

(54) ELECTRICAL CONTACT WITH PLURAL ARCH-SHAPED ELEMENTS

(75) Inventors: Charles Dudley Copper, Harrisburg, PA (US); Michael Laub, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/697,738

(22) Filed: Oct. 30, 2003

(65) Prior Publication Data

US 2005/0095926 A1 May 5, 2005

(51) Int. Cl.
*H01R 13/33* (2006.01)

(52) U.S. Cl. ..... 439/843; 439/841

(58) Field of Classification Search ..... 439/841, 439/843, 92, 95, 108; 174/35 R, 35 GC
See application file for complete search history.

(56) References Cited

U.S. PATENT DOCUMENTS

| | | | | | |
|---|---|---|---|---|---|
| 2,394,020 | A * | 2/1946 | Soreny | 439/843 |
| 3,132,913 | A * | 5/1964 | Pohl | 439/402 |
| 3,502,784 | A * | 3/1970 | Kunkel | 174/35 GC |
| 4,572,921 | A * | 2/1986 | May et al. | 174/35 GC |
| 4,725,251 | A * | 2/1988 | Neidecker et al. | 439/843 |
| 4,826,144 | A | 5/1989 | Balsells | |
| 5,360,355 | A | 11/1994 | Ehrler et al. | 439/816 |
| 5,474,309 | A * | 12/1995 | Balsells | 277/651 |
| 6,182,835 | B1 * | 2/2001 | Chen | 211/13.1 |
| 6,254,439 | B1 | 7/2001 | Endo et al. | 439/843 |
| 6,471,555 | B1 * | 10/2002 | Creze | 439/843 |
| 6,608,251 | B1 * | 8/2003 | Nurmi | 174/35 GC |
| 6,650,209 | B1 * | 11/2003 | Plummer et al. | 333/245 |
| 6,714,423 | B1 * | 3/2004 | Nurmi | 361/818 |
| 6,780,030 | B1 * | 8/2004 | Yoshinaga et al. | 439/92 |

FOREIGN PATENT DOCUMENTS

| | | |
|---|---|---|
| DE | 26 32 851 A1 | 4/1977 |
| EP | 0 716 474 A1 | 6/1996 |
| FR | 2 778 276 A | 11/1999 |

* cited by examiner

*Primary Examiner*—Hien Vu

(57) ABSTRACT

An electrical contact includes a conductor comprising a series of arch-shaped elements that are formed continuous with one another and extend along a centerline. Optionally, the arch-shaped elements are pitched at an acute angle with respect to the centerline and are arranged in separate parallel planes that are also oriented at an acute angle with respect to the centerline. The arch-shaped elements includes a pair of opposed leg portions, having first ends joined to a bridge portion and having second ends spaced apart to form an opening therebetween. The leg portions of adjacent arch-shaped elements are joined to one another at linking portions. The arch-shaped elements and the centerline can be arranged in a circular geometry about a center point.

16 Claims, 7 Drawing Sheets

ELECTRICAL CONTACT WITH PLURAL ARCH-SHAPED ELEMENTS

BACKGROUND OF THE INVENTION

The invention relates generally to electrical connectors and, more particularly, to power connectors and electromagnetic interference (EMI) suppression connectors.

In general, an electrical connector includes a dielectric housing that includes a plurality of contact cavities that hold a plurality of terminal contacts. An electrical connector typically is designed for mating with a complementary connector such that terminal contacts of the respective connectors engage to establish an electrical connection.

One particular type of electrical connector is a receptacle connector designed for receiving an electrical pin. Such connector designs are commonly used for power connector applications and for high frequency data or signal transmission as in telecommunications applications or with computers or other electronic devices where EMI shielding is desirable. In many of these applications, the connectors are mounted on printed circuit boards.

In at least one known receptacle connector, spring arms are cantilevered from the interior of the connector body and extend into the pin or contact cavity. A contact portion on the spring arm extends transversely into the pin cavity to engage the pin. In the case of power connections, the pressure applied to the contacts from the spring arms facilitates and maintains the connection. In the case of EMI suppression, a multiplicity of contacts in close proximity to one another is advantageous for high frequency shielding.

However, heretofore, the contact arms have experienced problems as they loose their resiliency over a period of time and are easily damaged or deformed by careless insertion of the pins into the terminal cavity.

One alternative connector contact is in the form of a canted coil spring as disclosed in U.S. Pat. No. 4,826,144 to Balsells. The Balsells patent describes a garter-type axially resilient coil spring that includes a plurality of coils which are connected in a clock-wise direction. Each coil has a leading portion and a trailing portion, where the trailing portion is along an inside diameter of the garter-type axially resilient coil spring and the leading portion is along an outside diameter of the garter-type axially resilient coil spring. The Balsells patent describes a method for making the garter-type axially resilient coil spring that includes the step of winding a wire to produce coils canted with respect to a centerline of the coil spring, with each coil having a leading portion and a trailing portion. The method includes winding the wire so that the leading portion is disposed to a line normal to the centerline of the garter-type axially resilient spring and the trailing portion is disposed at a back angle to the normal line. The back angle is adjusted to achieve a preselected resiliency. Thereafter, the two ends of the wound wire are attached forming a garter type axially resilient coil spring.

However, the coil spring of the Balsells patent has certain disadvantages. The coils are formed through a wire winding process that is complex and requires extensive manufacturing equipment and time. Consequently, the coil spring is expensive to produce.

Thus a need remains for a contact and a method of manufacturing of such a contact that is more cost effective.

BRIEF DESCRIPTION OF THE INVENTION

In one embodiment of the invention, an electrical contact is provided that includes a conductor comprising a series of arch-shaped elements that are formed continuous with one another and extend along a centerline. Optionally, the arch-shaped elements are pitched at an acute angle with respect to the centerline and are arranged in parallel planes that are also oriented at an acute angle with respect to the centerline. Each arch-shaped element includes a pair of opposed leg portions, having first ends joined to a bridge portion and having second ends spaced apart to form an opening therebetween. The leg portions of adjacent arch-shaped elements are joined to one another at linking portions. The arch-shaped elements and the centerline can be arranged in a circular geometry about a center point.

In another embodiment of the invention, an electrical connector includes a body having a mating face and a contact held in the body proximate the mating face. The contact includes a conductor folded into a series of arch-shaped elements that are formed continuous with one another and extend along a centerline.

In another embodiment of the invention, an electrical contact includes a series of arch-shaped elements arranged adjacent one another along a centerline. Each of the arch-shaped elements includes leg portions and a bridge portion integrally formed with the leg portions. The leg portions are positioned on opposite sides of the centerline. The arch-shaped elements are formed continuously with one another through linking portions that are integrally formed with the leg portions of adjacent arch-shaped elements. The arch-shaped elements are oriented at an angle with respect to the centerline.

In another aspect of the invention, a method of forming a contact, includes forming stock conductive material into a plurality of angled elements arranged in a flat serpentine geometry and bending the angled elements about a centerline to form an equal plurality of arch-shaped elements extending along the centerline.

In another aspect of the invention, a method for producing an electrical contact includes providing a continuous length of conductive material into a planar wave-type pattern wrapping back and fourth across a first centerline and bending the length of conductive material partially about a second centerline to create a plurality of arch-shaped elements.

DETAILED DESCRIPTION OF THE INVENTION

Figure 1:
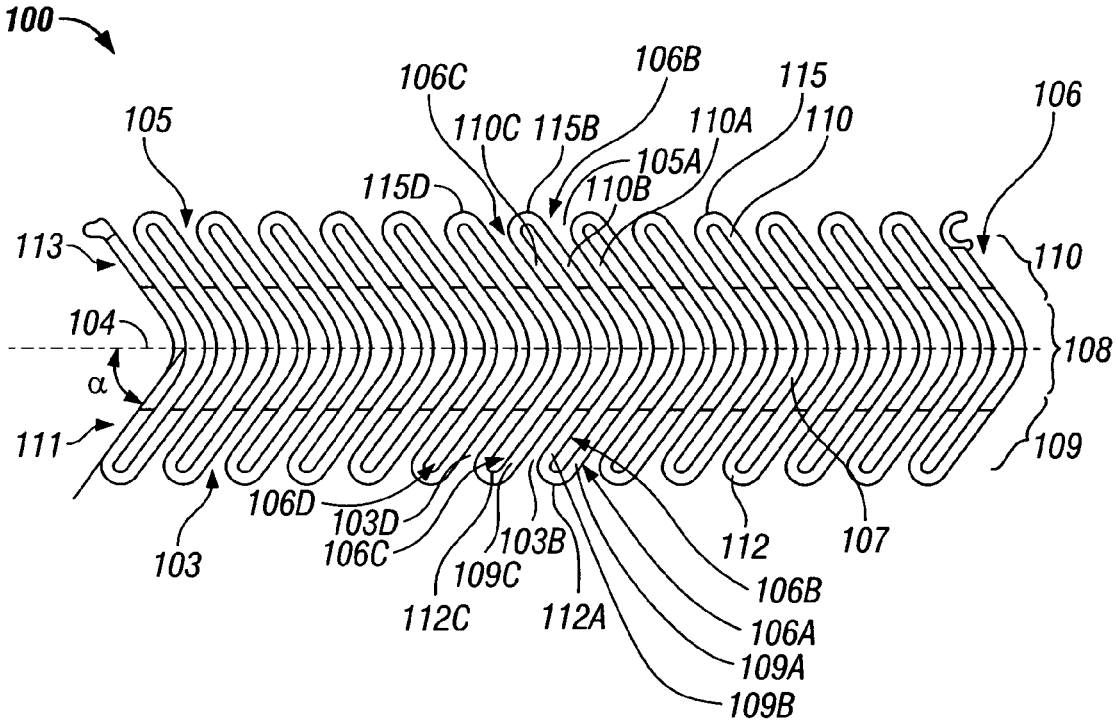
FIG. 1 illustrates a top plan view of a slanted rolled electrical contact formed in accordance with one embodiment of the present invention.

FIG. 1 illustrates a contact 100 that is formed from a sheet of conductive raw material (blank) in accordance with the present invention, such as by stamping and the like. The contact 100 is a continuous length of conductive material wrapped back and forth across a centerline 104 giving the contact 100 a wave-type or serpentine shape. The term serpentine as used herein shall refer to a continuous length of material arranged to wrap back and forth across a centerline 104 without overlapping or crossing back upon itself.

The contact 100 is arranged in a single plane and is evenly distributed along both sides of the centerline 104. The contact 100 may constitute a strand or trace having a square or rectangular cross-section depending upon the type of stamping or forming process used to produce or extract the contact 100 from a blank. Alternatively, the contact 100 may have a variety of other cross-sectional shapes, including circular, oval and non-circular.

In the example of FIG. 1, the contact 100 is formed with a uniform cross-sectional shape along the entire length. Optionally, the cross-sectional shape and dimensions (e.g., width, thickness, diameter) may be varied between different sections along the length of the contact 100.

The contact 100 comprises a series of chevron or obtusely angled elements 106 arranged in a nested, non-overlapping pattern. Each angled element 106 includes an apex 107 intersecting the centerline 104. Optionally, the angled elements 106 may be shaped acutely or at right angles. Each angled element 106 includes an arcuate section 108 that is formed integrally at opposite ends with a pair of legs 109 and 110. Certain legs 109 and 110 are joined by linking portions 112 and 115, while other legs 109 and 110 are separated by gaps 103 and 105. The arcuate sections 108 bend at apex 107 and intersect the centerline 104. The leg sections 109 and 110, which may be either substantially straight or may exhibit some curvature, extend outward from the centerline 104 at an acute angle $\alpha$. Adjacent angled elements 106 are formed integrally with one another through linking portions 112 and 115 provided alternately on sides 111 and 113 of the contact 100. The linking portions 112 interconnect adjacent legs 109 on side 111, and the linking portions 115 interconnect adjacent legs 110 on side 113.

More specifically, individual angled element 106A includes legs 109A and 110A. Individual angled element 106B includes legs 109B and 110B, and individual angled element 106C includes legs 109C and 110C. The leg 109A of the angled element 106A is connected to the leg 109B of adjacent angled element 106B through the linking portion 112A, while the leg 110B of the angled element 106B is connected to the leg 110C of adjacent angled element 106C by the linking portion 115B. Hence, adjacent angled elements 106A, B, C, etc. are formed integrally with one another at linking portions 112A, 115B, 112C, 115D, etc. arranged alternately along opposite sides 111 and 113.

Further, legs 109B and 109C are separated by gap 103B, while legs 110A and 110B are separated by gap 105A. Linking portions 112A, 112C, etc. are interleaved with gaps 103B, 103D, etc.

In an exemplary embodiment, the linking portions 112 and 115 are U-shaped. Alternatively, other shapes such as rounded, V-shaped, square, etc. are also contemplated. The contact 100, in an exemplary embodiment, is stamped from a blank (not shown). In an alternative embodiment, the contact 100 may be machined, cast, molded, formed from a wire and the like. Once the contact 100 is produced, it is bent, shaped, formed and the like as explained hereafter.

Figure 2:
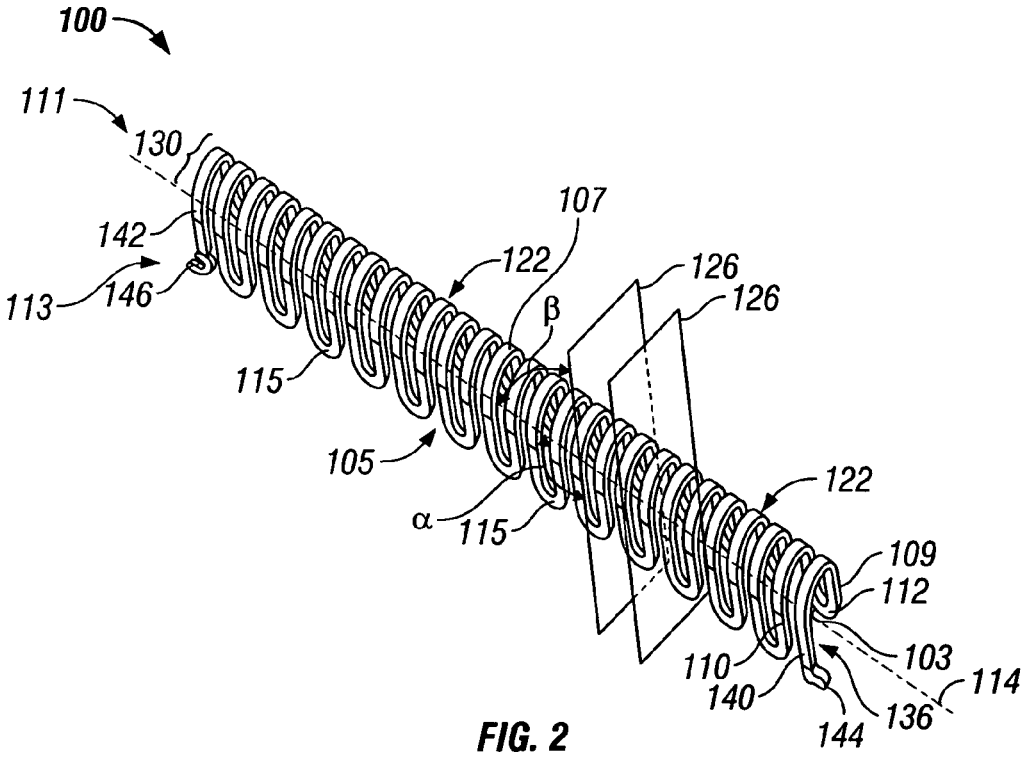
FIG. 2 illustrates a perspective view of a contact formed in accordance with one embodiment of the present invention.

FIG. 2 illustrates the contact 100 formed in accordance with one embodiment. The angled elements 106 are bent around a second centerline 114. The centerline 114 is substantially linear in FIG. 2 as contact 100 is for a linear application. However, centerline 114 may follow a variety of shapes and contours as explained hereafter. The contact 100 includes a plurality of slanted U-shaped or arch-shaped elements 122. The arch-shaped elements 122 may be oriented in parallel planes 126 that are oriented such that the centerline 114 extends therethrough. Each arch-shaped element 122 is slanted with respect to the centerline 114 such that the planes 126 are oriented at an acute angle $\beta$ to centerline 114. Hence, the arch-shaped elements 122 are tipped at an acute pitch angle $\beta$ toward one end 142 of the contact 100. The pitch angle $\beta$ is with respect to a vertical plane intersecting apex 107. Optionally, the arch-shaped elements 122 may be turned or twisted at an acute yaw angle $\gamma$ from side-to side. Each arch-shaped element 122 includes a bridge portion 130 that is formed with legs 109 and 110 extending from opposite sides thereof. The bridge portions 130 are formed when the arcuate sections 108 are bent to a desired shape about centerline 114. In an exemplary embodiment, the bridge portions 130 may be evenly curved with a generally convex outer profile. Alternatively, the bridge portion 130 can be formed in a variety of geometries such as V-shaped, an open-sided square, a half-octagon or other polygonal geometry.

The linking portions 112 and 115 are shown in FIG. 2 to interconnect the legs 109 and 110, respectively, of adjacent arch-shaped elements 122 on sides 111 and 113 of the centerline 114. In one embodiment, the arch-shaped elements 122 have an open bottom 136. Alternatively, the arch-shaped elements 122 may be formed with longer legs 109 and 110 bent further toward one another around the centerline 114 until touching or overlapping one another (such as in an interleaved relation). More specifically, the legs 109 and 110 may be bent until linking portions 112 and 115 are located immediately adjacent or at least partially within gaps 105 and 103, respectively.

The arch-shaped elements 122 include a first end 140 and a second end 142. The first end 140 may include a tab 144 that is configured to be joined with a complimentarily shaped latch 146 on the second end 142 to form a closed geometry, such as when the contact 100 is wrapped into an annular or square geometry. Optionally, ends 140 and 142 can be formed without the tab 144 and latch 146, in which case, the ends 140 and 142 can be joined by any suitable method such as soldering, welding, crimping, etc.

Figure 3:
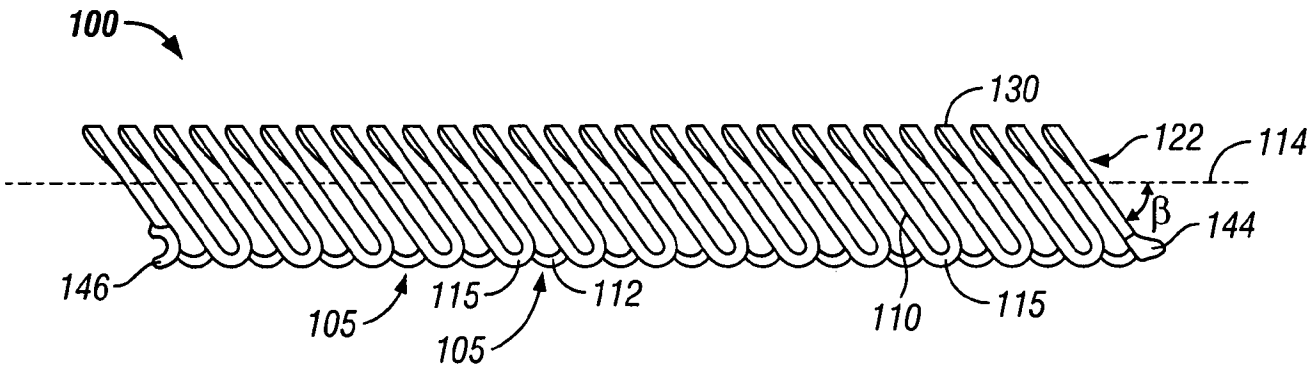
FIG. 3 illustrates a side elevational view of the contact of FIG. 2.

FIG. 3 is a side elevational view of the contact 100 to more clearly illustrate the slant or pitch $\beta$ of the arch-shaped elements 122. The angled elements 106 (shown in FIG. 1)

may be first bent to become the arch-shaped elements 122 wrapped around the centerline 114. Next, the arch-shaped elements 122 are slanted or pitched to a desirable acute angle β between the legs 110 and the centerline 114. Optionally, the bending and slanting operations may be done simultaneously. In an exemplary embodiment, the angles α and β may be substantially equal. FIG. 3 further illustrates the arrangement of linking portions 112 and 115, and gaps 105 relative to the legs 110 and bridge portions 130.

Figure 4:
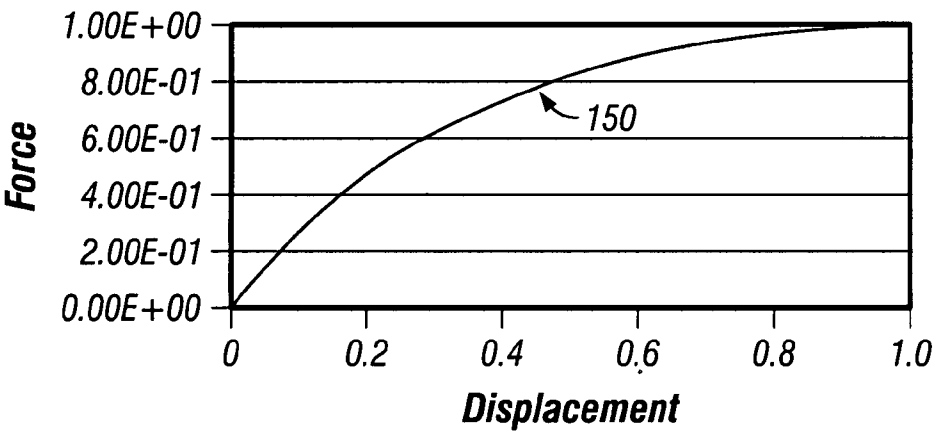
FIG. 4 illustrates a force/deflection curve corresponding to the response of the contact of FIG. 2.

FIG. 4 illustrates a force deflection response curve 150 for the contact 100. The horizontal axis represents normalized displacement of the contact from an unstressed free state to a fully stressed state (corresponding to the maximum operating range of the contact 100). The vertical axis represents the elastic force response exhibited by the contact 100 at each point of displacement (e.g., as the pitch angle β (FIG. 3) decreases). The response curve 150 tends to flatten at maximum displacement. However, the curve 150 is elastic throughout the displacement range shown in FIG. 4.

Figure 5:
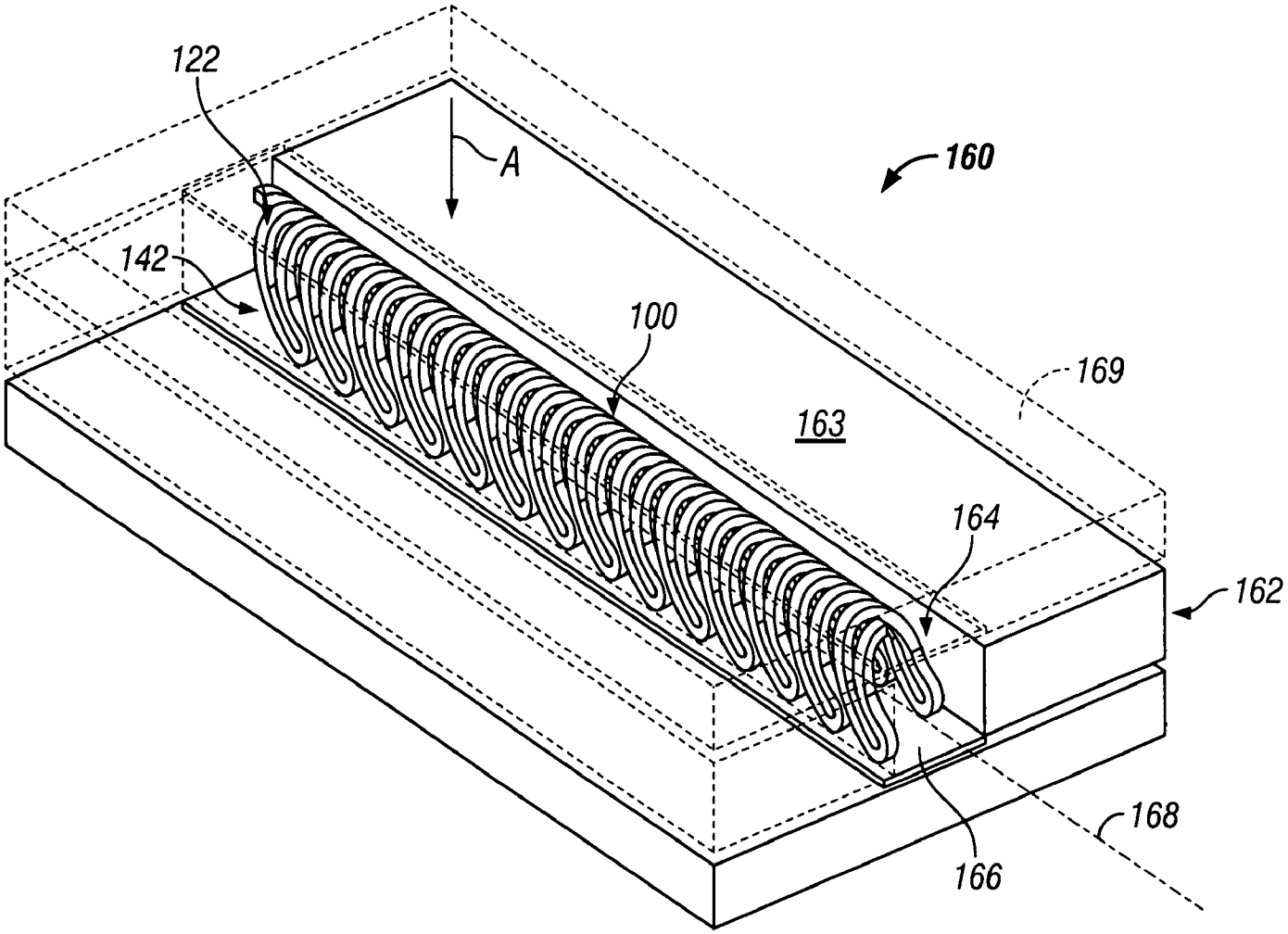
FIG. 5 illustrates a perspective view of a connector containing the contact of FIG. 2 arranged in a linear configuration in accordance with one embodiment of the present invention.

FIG. 5 illustrates a connector 160 that contains the linear contact 100. The connector 160 includes a body 162, a portion of which is shown in dashed lines to reveal the inner detail of the connector 160. The body 162 includes a mating face 163 having a contact channel 166 extending along a linear contact axis 168. The contact channel 166 has an open upper side 164 through which a contact 100 is received. The contact 100 compresses downward into the channel 166 in the direction of arrow A when a board 169, having a mating contact pad or trace, is pressed onto the body 162. As the board 169 is loaded onto the connector 160, the arch-shaped elements 122 slant or pitch forward toward end 142.

Figure 6:
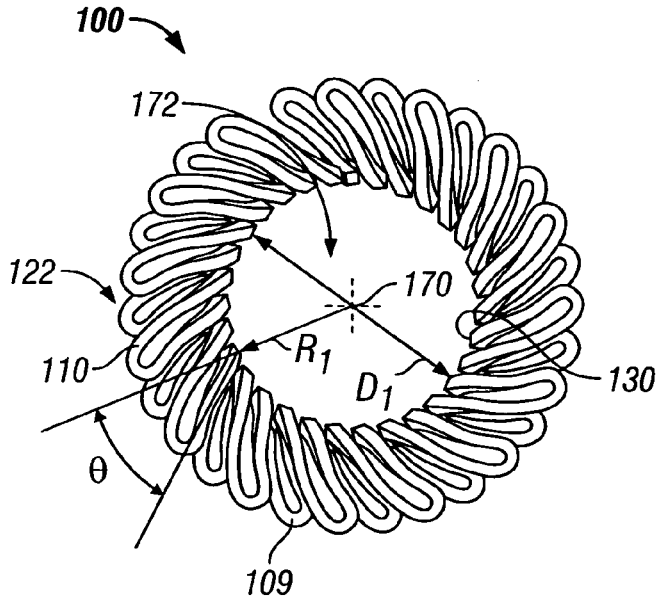
FIG. 6 illustrates a top plan view of the contact of FIG. 2 wrapped into an annular configuration in accordance with an embodiment of the present invention.

FIG. 6 illustrates the contact 100 formed in accordance with an alternative embodiment of the present invention. After bending and slanting the contact 100 (shown in FIG. 1) about the centerline 114 (shown in FIG. 2), the series of arch-shaped elements 122 are wrapped about a center point 170 until the ends 140 and 142 are joined. The contact 100, as shown in FIG. 6, is formed in a substantially annular or circular geometry, however, other geometries may be used, such as rectangular, square, oval, elliptical, etc. The center point 170 substantially corresponds to a pin receiving axis (extending out of the sheet in FIG. 6). The legs 109 and 110 of the arch-shaped elements 122 are oriented to spiral outwardly while the bridge portions 130 define a pin receiving opening 172 that has an internal diameter $D_1$. Each of the legs 109 and 110 of the arch-shaped elements 122 intersects a radius $R_1$ extending outward from center point 170 at an acute angle θ.

Figure 7:
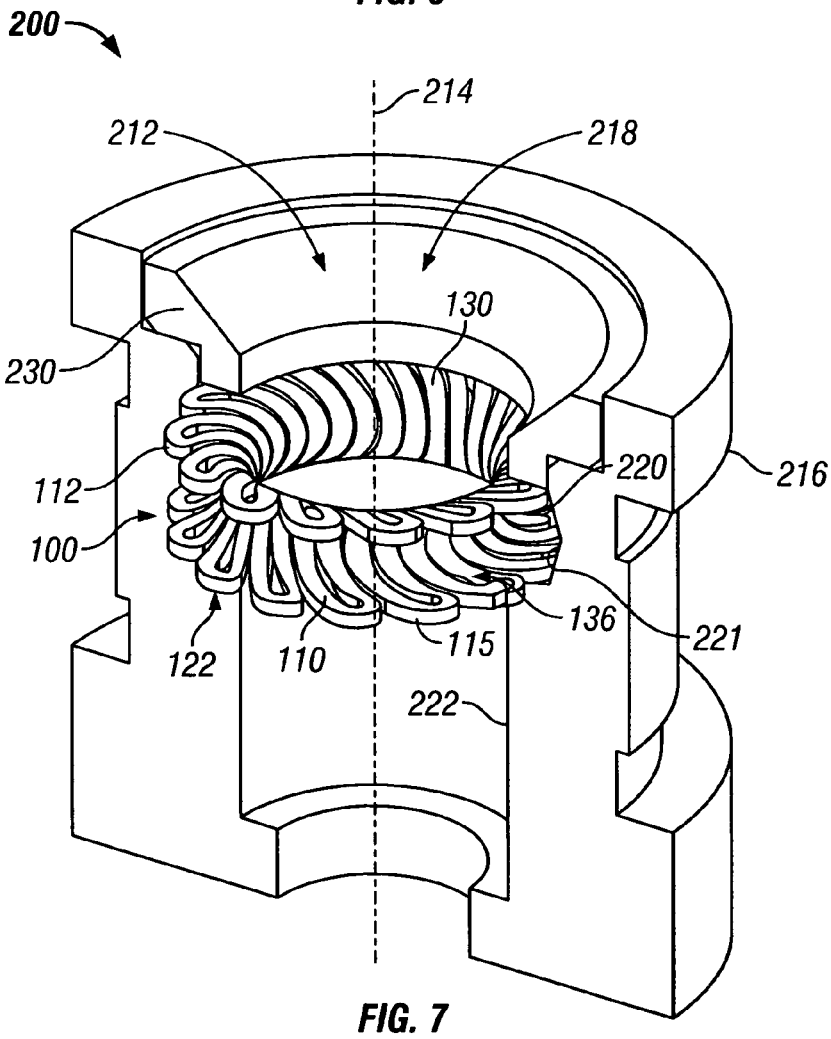
FIG. 7 illustrates a perspective cross sectional view of a connector containing the contact of FIG. 2 arranged in an annular configuration in accordance with an alternative embodiment of the present invention.

FIG. 7 illustrates a perspective cross sectional view of a connector 200 formed in accordance with an exemplary embodiment of the present invention. The connector 200 includes the contact 100 in the annular configuration of FIG. 6. The connector 200 includes a cavity 212 configured to receive a pin contact (not shown) along a pin receiving axis 214. The connector 200 includes a body 216 that has a beveled mouth 218 and a channel 220 defined by an interior wall 222. The channel 220 is shown in FIG. 7 as having a V-shaped bottom 221. It is to be understood that the contour of the channel bottom 221 is not significant to the invention and any contour may be used. The contact 100 is positioned in the channel 220 with the linking portions 112 and 115 of the arch-shaped elements 122 seated in the channel 220. The open bottom 136 of the arch-shaped elements 122 between the legs 109 and 110 faces outward from the pin receiving axis 214. The bridge portions 130 of the arch-shaped elements 122 engage the mating pin contact (not shown). The bridge portions 130 provide numerous contact points and enhance the quality of the electrical connection between the contact 100 and the mating pin contact (not shown). Similarly, the quality of the electrical connection is also enhanced by the multiple points of contact between the contact legs 109 and 110 and the connector body 216.

In one embodiment, the connector 200 may also include a retainer ring 230 for retaining the contact 100. Alternatively, the retainer ring 230 may be integrally formed with the body 216. As illustrated in FIG. 7, the body 216 of the connector 200 is itself conductive. The connector 200, in this embodiment, can be mounted on a circuit board or can be mounted on a bus bar in a power connector, or any other conductive element.

Figure 8:
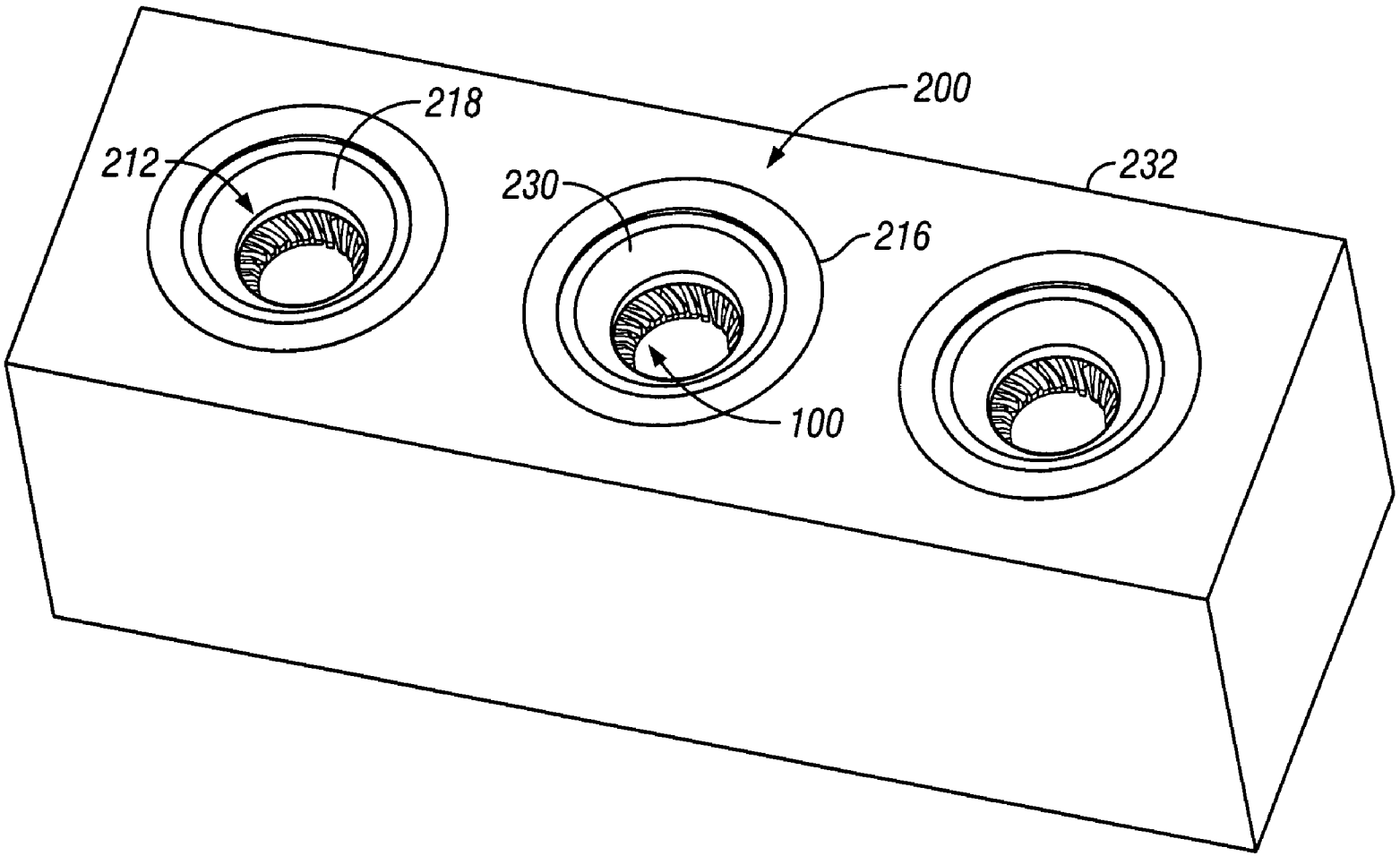
FIG. 8 illustrates a perspective view of the connector of FIG. 7 installed in a housing.

FIG. 8 illustrates multiple connectors 200 installed adjacent one another in an insulated housing 232. The housing 232 includes multiple cavities 212 with beveled mouths 218.

Figure 9:
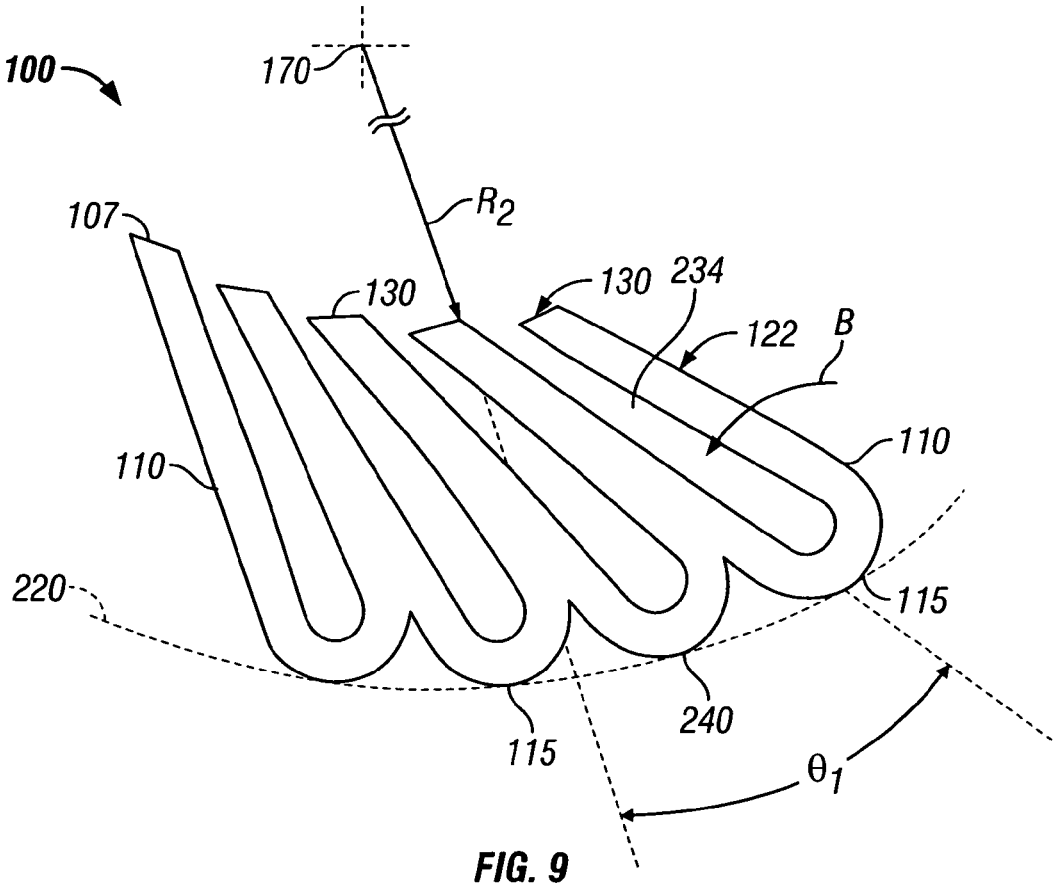
FIG. 9 illustrates a side view of a portion of the contact of FIG. 7 while in a free state.
Figure 10:
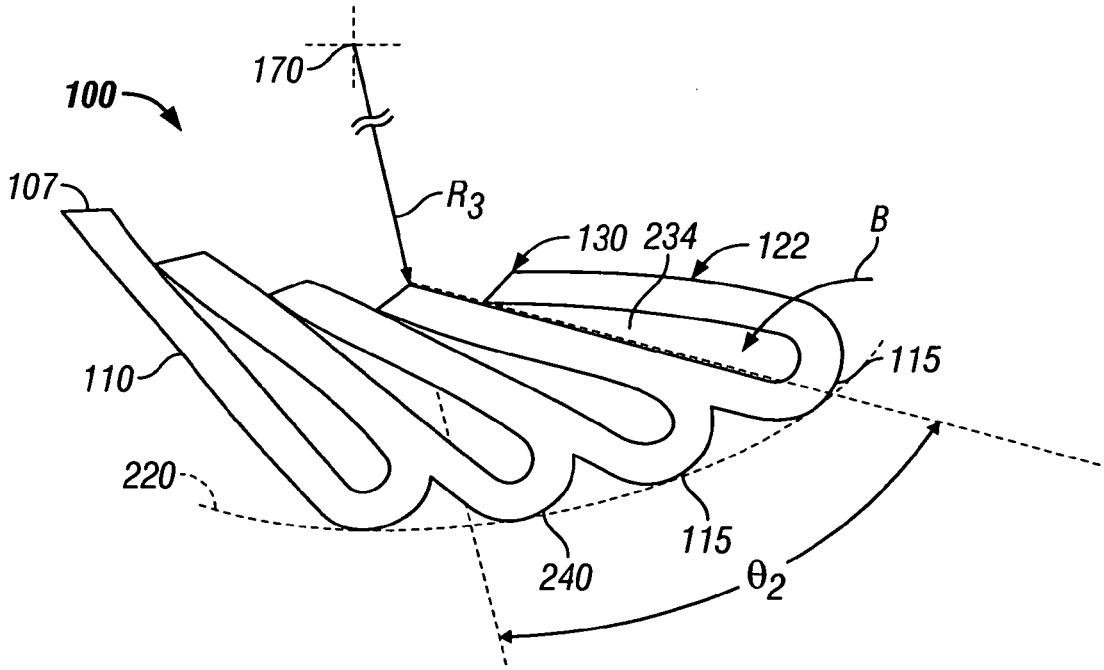
FIG. 10 illustrates a side view of a portion of the contact of FIG. 7 while in a stressed state.

FIGS. 9 and 10 illustrate the operation of the slanted contact 100 in the connector 200. FIG. 9 illustrates the contact 100 when unstressed in a free state (e.g., no pin is inserted), while FIG. 10 illustrates the contact 100 when in a stressed state (e.g., a pin is inserted). The arch-shaped elements 122 of the contact 100 are slanted at an angle $\theta_1$ with respect to a radius $R_2$ extending from the center point 170. The bridge portions 130 are oriented toward the center point 170 while the legs 110 extend from the bridge portions 130 toward the channel 220 (shown in dashed outline). Adjacent legs 110 are separated by a space 234 when unstressed, while gaps exist between apexes 107 of the bridge portions 130 of adjacent arch-shaped elements 122.

Being formed with the slant as illustrated in FIG. 9, the arch-shaped elements 122 are predisposed to react in a manner that effectively increases the slant or lean of the arch-shaped elements when a pin is inserted. First, the arch-shaped elements 122 are predisposed to pivot in the direction of arrow B about the point of contact 240 between the linking portions 115 and the contact cavity 220. Additionally, pin insertion expands the pin receiving opening 172 (shown in FIG. 6) causing the legs 110 of adjacent arch-shaped elements 122 to move toward one another, also in the direction of the arrow B, as the arch-shaped elements 122 pivot or flex at the linking portions 115.

With reference to FIG. 10, in the stressed state, the bridge portions 130 of the arch-shaped elements 122 are displaced from the unstressed position, enlarging the pin receiving opening 172 (shown in FIG. 6), while the space 234 between adjacent legs 110 is decreased. With the pin inserted, the arch-shaped elements 122 of the contact 100 are slanted at an angle $\theta_2$ with respect to a radius $R_3$ from the center point 170. The angle $\theta_2$ is greater than the angle $\theta_1$ and the radius $R_3$ is greater than the radius $R_2$ reflecting an expansion of the pin receiving opening 172 (shown in FIG. 6) from the insertion of the pin. The reaction of the contact 100 is such that the pin is received into the contact 100 with less likelihood that the contact 100 will be damaged such as from buckling of the legs 110 against the channel 220 of the connector body 216. The contact 100 also facilitates a reduction in peak insertion forces for the connector 200.

Figure 11:
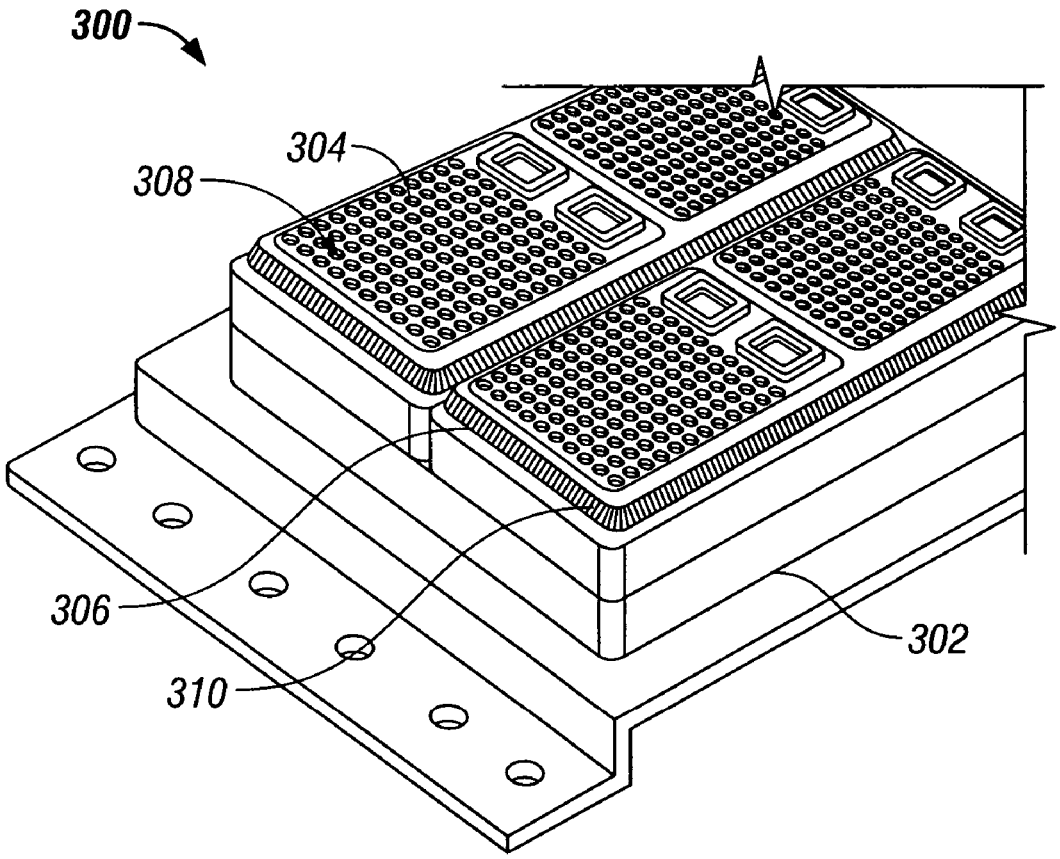
FIG. 11 illustrates a perspective view of a connector containing a plurality of the contacts of FIG. 2 arranged in rectangular configurations in accordance with an embodiment of the present invention.

FIG. 11 illustrates a connector 300 that may be used for electromagnetic interference (EMI) suppression. The connector 300 includes a body 302 that is a ground shield. The body 302 surrounds a plurality of signal contacts (not shown) within contact cavities 304. The body 302 includes a channel 306 on an external perimeter thereof proximate a mating face 308. A contact such as the contact 310 is received and retained in the channel 306. The contact 310 is formed by wrapping the arch-shaped elements 122 (see FIG. 2) such that the legs 109 and 110 extend radially inwardly and the dome portions 130 form the outside diameter of the contact. The contact 310 is installed on the exterior of the ground shield body 302 such that the legs (not shown in FIG. 11) of the contact 310 extend inwardly into the channel 306.

The embodiments thus described provide an electrical contact that is a cost effective contact for connectors designed for receiving a pin contact. The contact provides redundant points of contact for carrying current in power connector applications. The contact is also suitable for use in EMI suppression in high speed data connector applications.

While the invention has been described in terms of various specific embodiments, those skilled in the art will recognize that the invention can be practiced with modification within the spirit and scope of the claims.

What is claimed is:

1. An electrical contact comprising:

a conductor comprising a series of arch-shaped elements that are continuously formed with one another and extend along a centerline, wherein said arch-shaped elements are aligned to transverse said centerline and are pitched at an acute angle with respect to said centerline, said arch-shaped elements each having a pair of opposed leg portions joined by a bridge portion, each said bridge portion being configured to engage a mating contact along a direction traversing said centerline, wherein said leg portions of adjacent said arch-shaped elements are straight and are joined to one another on alternating sides of said arch-shaped elements, wherein said bridge portions are bent in an arch shape, wherein said arch-shaped elements and said centerline are arranged in a linear geometry.

2. The contact of claim 1, wherein each said leg portions are provided along opposite sides of the contact, and wherein said leg portions of adjacent arch-shaped elements are joined to one another at linking portions, all of said leg portions being slanted in a common direction with respect to said centerline, the linking portions flexing to permit said arch-shaped elements to slant with respect to said centerline when engaging a mating contact.

3. The contact of claim 1, wherein said leg portions of adjacent said arch-shaped elements are joined to one another on alternating sides of said arch-shaped elements.

4. The contact of claim 1, wherein said leg portions in each said pair of opposed leg portions are separated to provide an open bottom.

5. An electrical contact comprising:

a conductor comprising a series of arch-shaped elements that are continuously formed with one another and extend along a centerline, wherein said arch-shaped elements are aligned to transverse said centerline and are pitched at an acute angle with respect to said centerline, said arch-shaped elements each having a pair of opposed leg portions joined by a bridge portion, each said bridge portion being configured to engage a mating contact along a direction traversing said centerline, wherein each said pair of opposed leg portions are arranged in a plane, adjacent said arch-shaped elements being arranged in parallel said planes, said leg portions of adjacent said arch-shaped elements being joined to one another on alternating sides of said arch-shaped elements.

6. An electrical contact comprising:

a conductor comprising a series of arch-shaped elements that are continuously formed with one another and extend along a centerline, wherein said arch-shaped elements are aligned to transverse said centerline and are pitched at an acute angle with respect to said centerline, said arch-shaped elements each having a pair of opposed leg portions joined by a bridge portion, each said bridge portion being configured to engage a mating contact along a direction traversing said centerline, wherein said leg portions of adjacent said arch-shaped elements are straight and are joined to one another on alternating sides of said arch-shaped elements, wherein said bridge portions are bent in an arch shape, wherein said arch-shaped elements and said centerline are arranged in a circular geometry about a center point.

7. The contact of claim 6, wherein said conductor includes latch and tab members at opposite ends thereof, said latch member is configured to be joined to said tab member.

8. The contact of claim 6, wherein said centerline defines a reference diameter about said center point, said arch-shaped elements being oriented at an acute angle with respect to radial lines extending outward from said center point, and wherein said arch-shaped elements lean when compressed, increasing said acute angle.

9. An electrical connector comprising:

a body having a mating face; and a contact held in said body proximate said mating face, said contact comprising a conductor folded into a series of arch-shaped elements that are formed continuous with one another and extend along a centerline, wherein said arch-shaped elements are oriented at an acute angle with respect to said centerline, wherein each said arch-shaped element has a pair of opposed leg portions joined by a curved bridge portion, said leg portions of adjacent arch-shaped elements being arranged in parallel planes and being joined to one another on alternative sides of said arch-shaped elements by linking portions the bridge portions being engaged by a mating contact and the linking portions flexing.

10. The electrical connector of claim 9, wherein said body is conductive and is disposed within an insulated housing.

11. The electrical connector of claim 9, wherein each said arch-shaped element includes an open bottom located opposite the bridge portion across said centerline.

12. The electrical connector of claim 9, wherein said leg portions are located on opposite sides of the centerline and are straight.

13. The electrical connector of claim 9, wherein said conductor includes opposite ends, said contact being held in said body with said ends located remote from one another.

14. The electrical connector of claim 9, wherein each said arch-shaped element includes an open bottom opening outward from said bridge portion.

15. The electrical connector of claim 9, wherein said arch-shaped elements are arranged in said parallel planes that are oriented at said acute angle to said centerline.

16. An electrical contact, comprising:

a series of arch-shaped elements arranged adjacent one another along a centerline, each said arch-shaped element includes a pair of straight leg portions and a bridge portion integrally formed with said leg portions and arranged in a plane, said leg portions being positioned on opposite sides of said centerline, adjacent said arch-shaped elements being arranged in parallel planes and joined continuous with one another through linking portions that are integrally formed with said leg portions of adjacent arch-shaped elements on alternating sides of said arch-shaped elements, said arch-shaped elements being oriented at an acute angle with respect to said centerline.

* * * * *